US010106939B2

(12) United States Patent
Neusch

(10) Patent No.: US 10,106,939 B2
(45) Date of Patent: Oct. 23, 2018

(54) BRACE AND BEAM ANTI-RAM PASSIVE VEHICLE BARRIER

(71) Applicant: Neusch Innovations, LP, Marble Falls, TX (US)

(72) Inventor: William H. Neusch, Marble Falls, TX (US)

(73) Assignee: Neusch Innovations, LP, Marble Falls, TX (US)

( * ) Notice: Subject to any disclaimer, the term of this patent is extended or adjusted under 35 U.S.C. 154(b) by 0 days.

(21) Appl. No.: 15/135,400

(22) Filed: Apr. 21, 2016

(65) Prior Publication Data

US 2016/0312418 A1 Oct. 27, 2016

Related U.S. Application Data

(60) Provisional application No. 62/151,370, filed on Apr. 22, 2015, provisional application No. 62/165,163, filed on May 21, 2015.

(51) Int. Cl.
*E01F 13/12* (2006.01)
*E01F 15/00* (2006.01)

(52) U.S. Cl.
CPC ..... *E01F 13/12* (2013.01); *E01F 15/00* (2013.01)

(58) Field of Classification Search
CPC ..... E01F 15/00; E01F 15/003; E01F 15/04; E01F 15/145; E01F 15/146; E01F 15/148; E01F 13/00
USPC ..... 404/6
See application file for complete search history.

(56) References Cited

U.S. PATENT DOCUMENTS 1,222,020 A 4/1917 Myers
1,749,190 A * 3/1930 McGregor ..... E01F 13/02 182/186.2
1,849,167 A * 3/1932 Bente ..... E01F 15/0423 256/13.1
3,258,250 A * 6/1966 McMullin ..... E01D 19/103 256/13.1
3,447,786 A 6/1969 Bigni
4,778,250 A * 10/1988 McRoskey ..... E01F 13/02 256/64
5,664,905 A 9/1997 Thompson et al.
5,720,470 A 2/1998 Johansson
6,290,427 B1 * 9/2001 Ochoa ..... E01F 15/0423 256/13.1

(Continued)

FOREIGN PATENT DOCUMENTS

GB 2481647 A 4/2012

OTHER PUBLICATIONS

U.S. Dept. of State, DS-41 K-4 Anti-Ram Fence Details, Feb. 4, 2010.

(Continued)

*Primary Examiner* — Thomas B Will
*Assistant Examiner* — Katherine J Chu
(74) *Attorney, Agent, or Firm* — Winstead PC

(57) ABSTRACT

A brace and beam vehicle barrier in accordance to at least one embodiment includes a plurality of interconnected beam sections, forming a beam positioned above ground level and secured to the ground via a plurality of spaced apart braces connected to the beam on a protected side of the beam, the brace and the ground forming two sides of a triangle to provide a stopping force to a motor vehicle impacting the beam from an attack side.

30 Claims, 10 Drawing Sheets

(56) References Cited

U.S. PATENT DOCUMENTS 6,533,249 B2 * 3/2003 Ochoa ..... E01F 15/0423 256/13.1
6,644,888 B2 * 11/2003 Ochoa ..... E01F 15/0438 404/6
6,666,616 B2 * 12/2003 Yodock, III ..... E01F 15/083 256/13.1
6,783,116 B2 * 8/2004 Albritton ..... E01F 15/143 256/13.1
6,932,327 B2 * 8/2005 Alberson ..... E01F 15/06 256/13.1
7,144,186 B1 12/2006 Nolte
7,367,549 B2 * 5/2008 Titmus ..... E01F 15/06 256/13.1
7,866,913 B2 * 1/2011 Kulp ..... E01F 15/086 256/13.1
8,235,359 B2 * 8/2012 Dyke ..... E01F 15/146 256/13.1
2003/0081997 A1 * 5/2003 Kramer ..... E01F 15/145 404/6
2005/0191125 A1 * 9/2005 Albritton ..... E01F 15/0423 404/6
2014/0110651 A1 * 4/2014 Cox ..... E01F 15/04 256/13.1
2016/0017555 A1 1/2016 Kemper et al.

OTHER PUBLICATIONS

Baker, Vehicle Fence Type 1 Gate, Apr. 3, 2008.
Baker, Personnel-Vehicle Type 2A, Nov. 4, 2007.
Baker, Vehicle Fence Type 1, Apr. 21, 2008.
International Search Report and Written Opinion, PCT/US2016/028690, dated Jul. 15, 2016.

* cited by examiner

BRACE AND BEAM ANTI-RAM PASSIVE VEHICLE BARRIER

BACKGROUND

This section provides background information to facilitate a better understanding of the various aspects of the disclosure. It should be understood that the statements in this section of this document are to be read in this light, and not as admissions of prior art.

Vehicle barrier systems are utilized to guard against access to protected areas. In particular, the systems are provided to stop motor vehicles, such as trucks, from being intentionally driven into certain areas for nefarious purposes. At least one agency of the United States Government has provided standards to certify barriers for use.

SUMMARY

An anti-ram vehicle barrier according to aspects of the disclosure includes a longitudinally extending beam positioned above a ground level, the beam having beam sections interconnected at joints and a brace positioned on a protected side of the beam and having a first end connected to the beam and a second end in a foundation such that the brace and the foundation form two adjacent sides of a vertex having an acute angle. The joints may have a pivot connection. One or more braces may be connected to the joints. A brace may be connected between the joints. Vertical posts may be connected to the beam. In some embodiments, the braces may be connected to the beam and a vertical post such that the beam, the post and the foundation form a triangle.

A method according to the disclosure includes installing an anti-ram vehicle barrier that includes for example a longitudinally extending beam positioned above a ground level, the beam having beam sections interconnected at joints and a brace positioned on a protected side of the beam and having a first end connected to the beam and a second end in a foundation such that the brace and the foundation form two adjacent sides of a vertex having an acute angle.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
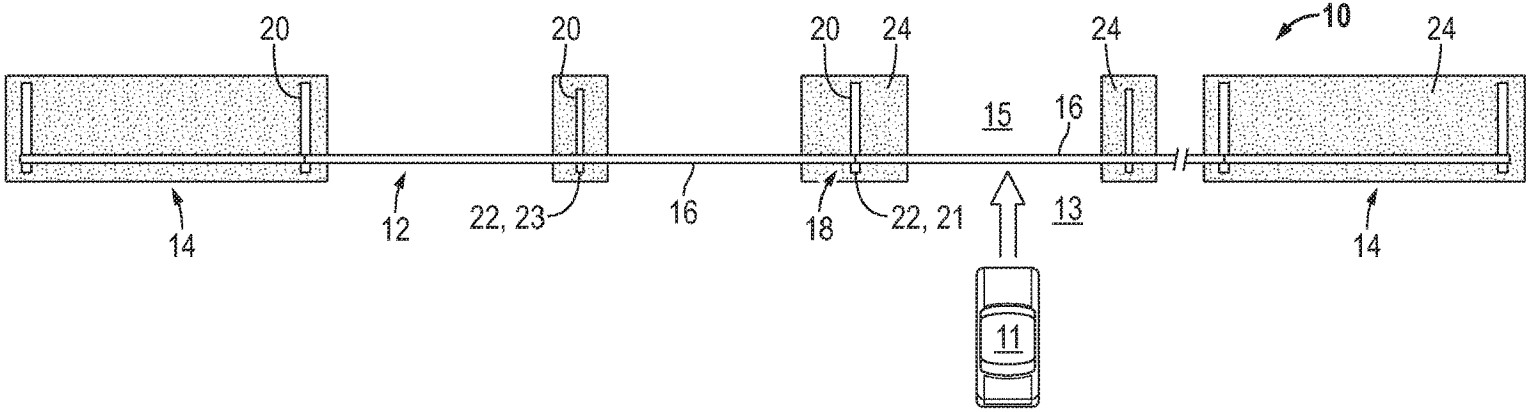
FIG. 1 is a plan view of a section of an anti-ram passive vehicle barrier according to aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

Figure 2:
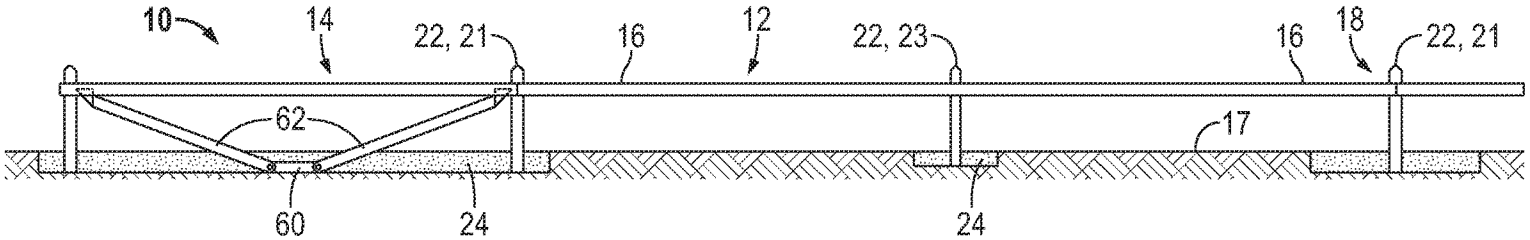
FIG. 2 is an elevation view of a portion of the anti-ram passive vehicle barrier of FIG. 1.
Figure 3:
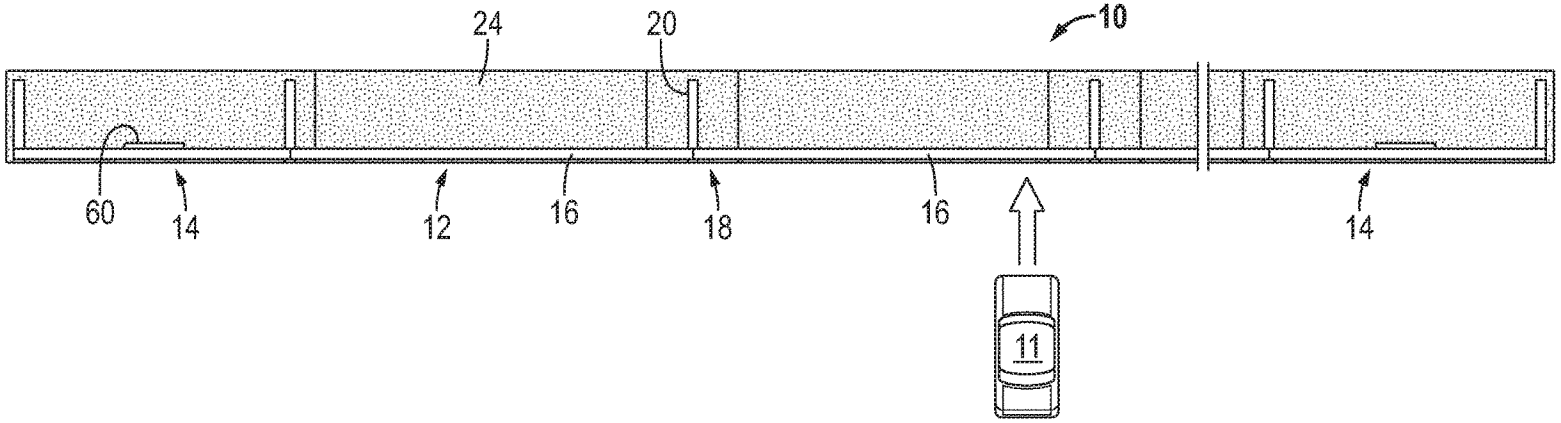
FIG. 3 is a plan view of a section of an anti-ram passive vehicle barrier according to aspects of the disclosure.
Figure 4:
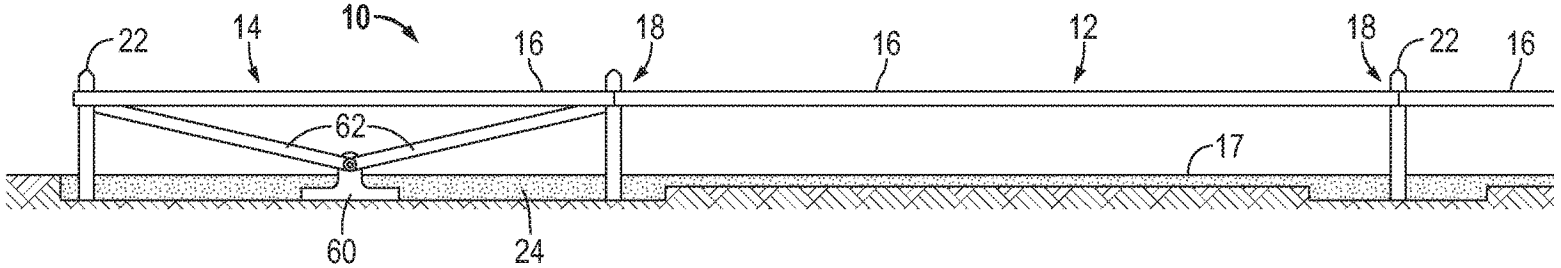
FIG. 4 is an elevation view of a portion of the anti-ram passive vehicle barrier of FIG. 3.

FIGS. 1 and 3 are plan views of examples of sections of a passive vehicle barrier (PVB), generally denoted by the numeral 10, in accordance to aspects of this disclosure. FIGS. 2 and 4 are elevation views from an attack side of the PVBs illustrated respectively in FIGS. 1 and 3.

The barrier 10 is configured to stop the penetration of a motor vehicle that crashes into the barrier. The barrier 10 should fully stop any impacting vehicle within a desired penetration distance, for example to keep explosives carried by the vehicle at a selected stand-off distance from facilities located within the barrier perimeter. United States federal agencies (e.g., the U.S. Department of Defense (DOD) and the Department of State (DOS)) have developed test standards using crash tests to quantify, verify, and certify barrier performance. Such test methods were initially published by the U.S. Dept. of State in 1985 as SD-STD-02.01, which was revised in 2003 as SD-STD-02.01 Revision A, and which was replaced in 2009 with ASTM F2656 (Standard Test Method for Vehicle Crash Testing of Perimeter Barriers). Embodiments of the disclosed PVB 10 are configured to be crash-rated by certifying agencies such as DOD, DOS, ASTM and British Standards (BSI). Vehicle barriers are tested by crashing a motor vehicle from a perpendicular direction into the barrier. The vehicle barrier is rated based on the test vehicles weight, the speed of impact, and the penetration of the vehicle (e.g., the cargo bed) beyond the pre-impact inside edge of the barrier. For example, a "K" or "M" designates a medium duty vehicle with a gross-weight of 15,000 pounds (6810 kg). The speed ratings include K4/M30 for traveling at 28.0 to 37.9 miles per hour (mph); K8/M40 traveling at 38.0 to 46.9 mph, and K12/M50 traveling at 47.0 mph and above. The penetration ratings include P1 for less than or equal to 1 meter (3.3 ft.); P2 for 1.10 to 7 m (3.31 to 23.0 ft.); P3 for 7.01 to 30 m (23.1 to 98.4 ft.); and P4 for 30 m (98 ft.) or greater. For example, a M50 P1 crash barrier is designed to stop a medium duty truck traveling 50 mph with a penetration distance of 3.3 feet or less.

In FIGS. 1 and 3 the PVB 10 is positioned between a protected side 15 and a motor vehicle 11 approaching the PVB 10 from an attack side 13. In accordance to aspects of the disclosure, the PVB 10 is configured to achieve a crash-rating. In accordance to some embodiments, the PVB 10 is configured to achieve a crash-rating of M50 P1. In accordance to some embodiments, the PVB 10 is configured to achieve a crash-rating based upon a motor vehicle 11 impacting the barrier in a span between the braces.

The barrier 10 includes a continuous beam 12 positioned above ground level 17 and extending a distance between opposing truss sections 14, which for purposes of description are illustrated at the opposing ends of the continuous beam 12. In accordance to embodiments, one or more truss sections may be positioned within the span of the continuous beam. The continuous beam 12 is formed of interconnected beam sections 16 that are interconnected at joints 18. The length of the beam sections 16 can vary, for example, 20, 30, and 40 foot sections. In accordance to some embodiments, the joints 18 are pivoting connections that permit a degree of pivoting movement between the interconnected beams sections when the beam is impacted by a motor vehicle. Spaced apart braces 20 are located on the protected side of the beam 12, connected to the beam at a first end and secured in a foundation 24 at a second end, whereby the foundation and the brace form two adjacent sides of a vertex having an acute angle. The brace and the foundation form a sled to absorb or counter the impact force of the vehicle 11. The braces 20 may be connected to the beam 12 at the joints 18 (see, e.g., FIGS. 7 and 10) and/or connected to the beam 12 at intermediate positions between the joints 18 (e.g., see FIG. 16). Although the braces 20 are illustrated in FIGS. 1 to 4 as being located with posts 22, the braces may be located separate from a post.

Posts generally denoted by the numeral 22 may be connected to the beam 12 for example to support the beam above the ground level and to provide tension to mitigate lift of the beam in response to impact of the motor vehicle. In FIGS. 1-4 the posts are shown located with the braces for example to form a third side of the triangle with the brace and the foundation. The posts may be positioned at different locations from the braces and the braces may be connected with the beam 12 without being connected also to a post. The posts 22 may be arranged for example in a line post configuration, identified specifically with reference number 21, for connecting with the beam 12 at a joint 18 or arranged in an intermediate configuration, identified specifically with reference number 23, to connect to the beam 12 at an intermediate position between joints 18. Some or all of the posts may also be utilized to support an ornamental fence structure, e.g. a chain link section.

In accordance to aspects of the disclosure, the foundation 24 is concrete and may be a shallow or a deep foundation. A shallow foundation may be considered for example having a depth of about twenty inches or less. In accordance to aspects of the system the foundation, 24 may be about eighteen inches or less. In accordance to aspects of the system the foundation, 24 may be about twelve inches or less. In accordance to aspects of the system the foundation, 24 may be about six inches or less. The foundation 24 may extend the length of the continuous beam 12 as shown for example in FIGS. 3 and 4 or a concrete foundation may be provided only at the braces 20 as illustrated in FIGS. 1 and 2.

Figure 5A:
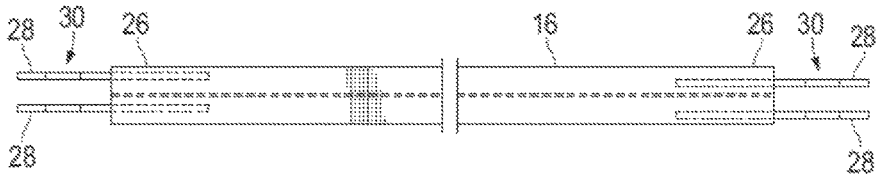
FIGS. 5A and 5B are views of a beam section according to aspects of the disclosure.
Figure 5B:
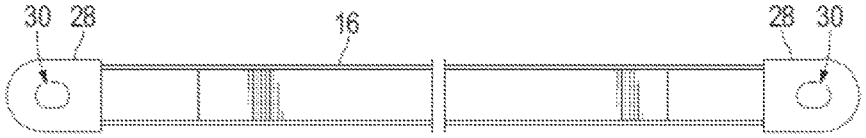
Figure 6:
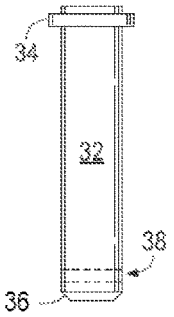
FIG. 6 illustrates an example of a pivot pin according to aspects of the disclosure.

FIGS. 5A and 5B illustrate an example of a beam section 16 in accordance to aspects of the disclosure. Beam section 16 is a metal member, for example an I-beam, for example a wide flange beam or W-beam, extending between opposing terminal ends 26. The beam section may be provided in different lengths. For example, in FIGS. 1 and 2, the beam sections 16 may be forty-feet and in FIGS. 2 and 3 the beam sections 16 may be for example twenty-feet or thirty feet in length. The dimensions described are non-limiting examples. In this example, a beam plate 28 having a central aperture or hole 30 is connected at each terminal end 26. In the illustrated example, two beam plates are spaced apart vertically and connected at each terminal end 26 with the holes 30 coaxially aligned to dispose a pivot pin 32 as illustrated for example in FIG. 6. Pin 32 includes a head 34 opposite a tail end 36, which may include cross-hole 38 for example to dispose a locking member, see e.g. FIG. 14.

Figure 7:
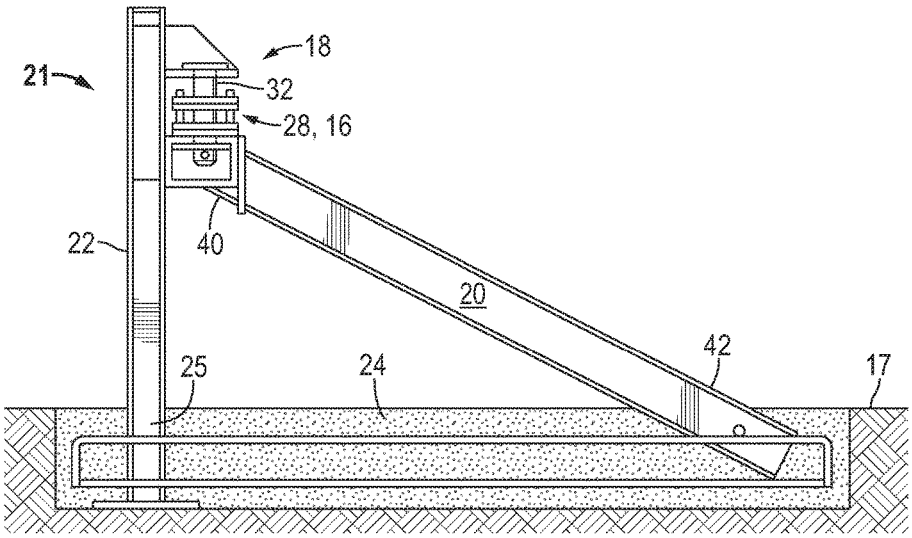
FIG. 7 illustrates a brace connected to a beam at a joint between beam sections according to aspects of the disclosure.
Figure 8A:
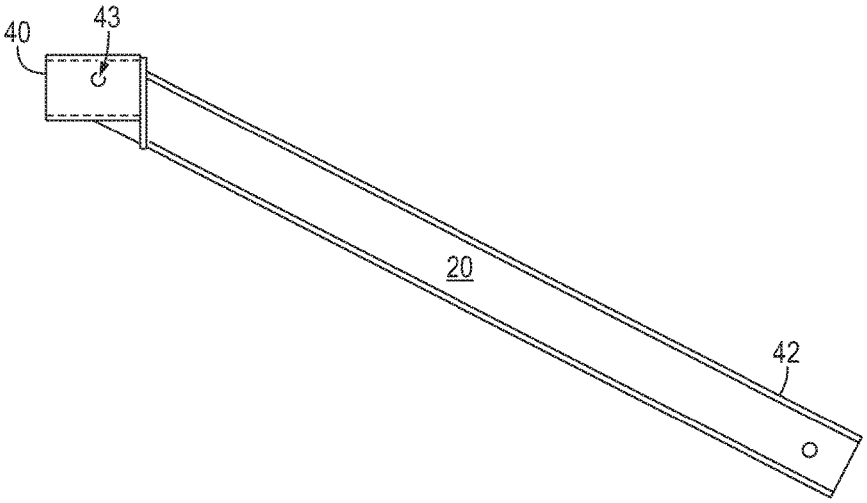
FIGS. 8A and 8B illustrate an example of the brace of FIG. 7.
Figure 8B:
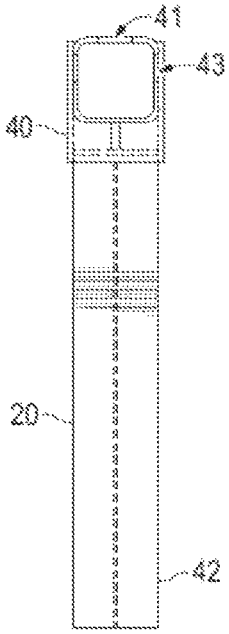

FIG. 7 illustrates an example of a brace 20 connected to a beam at a joint 18 between beam sections. With reference also to FIGS. 8A and 8B, the brace 20 is for example a metal member extending from a first end 40, which is in connection with the beam sections 16 via pivot pin 32 to a second end 42, which is disposed in the foundation 24. The brace 20 may be constructed for example of an I-beam type member, e.g., W-beam. In this example, the foundation is a shallow concrete foundation extending for example about 18 inches or less below the ground level. In some embodiments, the foundation is a shallow concrete foundation extending for example about 12 inches or less below the ground level.

In this example the first end 40 is a substantially rectangular shaped member extending horizontal relative to ground level and having a vertical hole 41, through which the tail end of the pin 32 is disposed, and a cross-hole 43, which can be aligned with the cross-hole 38 in the pivot pin. The beam plates of the adjacent beam sections are overlapped with the holes 30 (FIG. 5B) coaxially aligned and positioned atop the first end 40 of the brace 20. The pin 32 is then disposed through the coaxial holes 30 of the beam plates and through the vertical hole 41 providing a pivoting connection between the adjacent beam sections 16 and the brace 20. The brace 20 in combination with the foundation 24 forms a sled to absorb the force of the impact of the motor vehicle from the attack side. The foundation 24 and the brace 20 form two adjacent sides of a vertex having an acute angle 7.

In accordance to some embodiments, a vertical post 22, in a line post configuration 21, is connected with brace 20 and with the beam at the joint 18. The vertical post 22 is a metal member having a bottom end 25 that is located in the foundation 24. Post 22 may take various forms including I-beams, round or rectangular (e.g., square) members. In the example of FIG. 7, also illustrated in FIGS. 1 and 2, the posts are positioned on the attack side relative to the beam. In accordance to aspects of the disclosure, the vertical posts serve as a mechanism to maintain the beam at a selected height above ground level and can serve as a tension member when the beam is impacted by a motor vehicle.

Figure 9A:
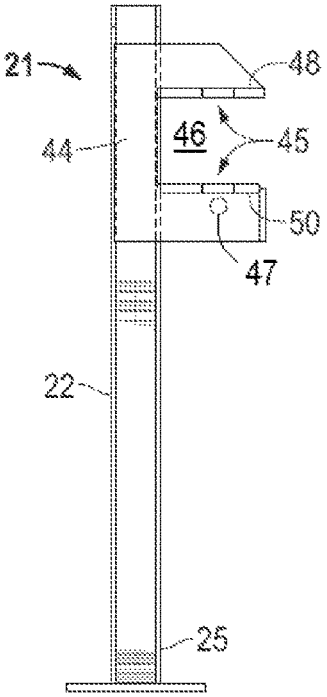
FIGS. 9A and 9B illustrate an example of a line post that may be connected to the brace in FIG. 7 according to aspects of the disclosure.
Figure 9B:
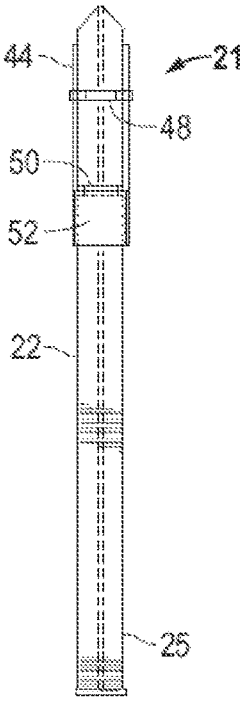

FIGS. 9A and 9B illustrate an example of a post 22 utilized as a line post 21 in FIG. 7. The illustrated line post 21 includes a C-shaped frame 44 forming a cavity 46 between a top shelf 48 and a bottom shelf 50 and coaxial holes 45 through shelves 48, 50. In this example, the bottom shelf 50 is formed by a rectangular member having a pocket 52 sized to dispose the first end 40 of the brace 20. With reference also to FIGS. 7, 8A and 8B the beam plates 28 of the adjacent beam sections are positioned in the cavity 46 and the first box end 40 of the brace 20 is positioned inside of the pocket 52. The pivot pin 32 is positioned in the coaxial holes 45 of the top and bottom shelves 48, 50, the vertical hole 41 and the holes 30 in the beam plates 28. The pivot pin 32 can be secured by positioning a locking member 56 (see, e.g., FIGS. 10 and 14) in the aligned cross-holes 47, 43, 38, in the bottom shelf 50, the first box end 40 and the tail end 36 of the pivot pin 32. A tamper resistant connection is formed with the head of the pivot pin flush mounted and the tail of the pivot pin located in the pocket and the first end of the brace.

Figure 10:
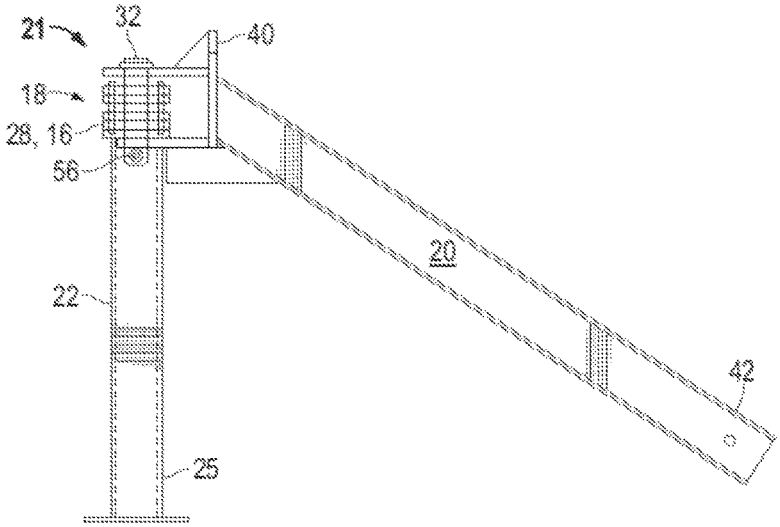
FIG. 10 is an elevation view of an example of a brace connected to a beam at a joint between beam sections according to aspects of the disclosure.
Figure 11:
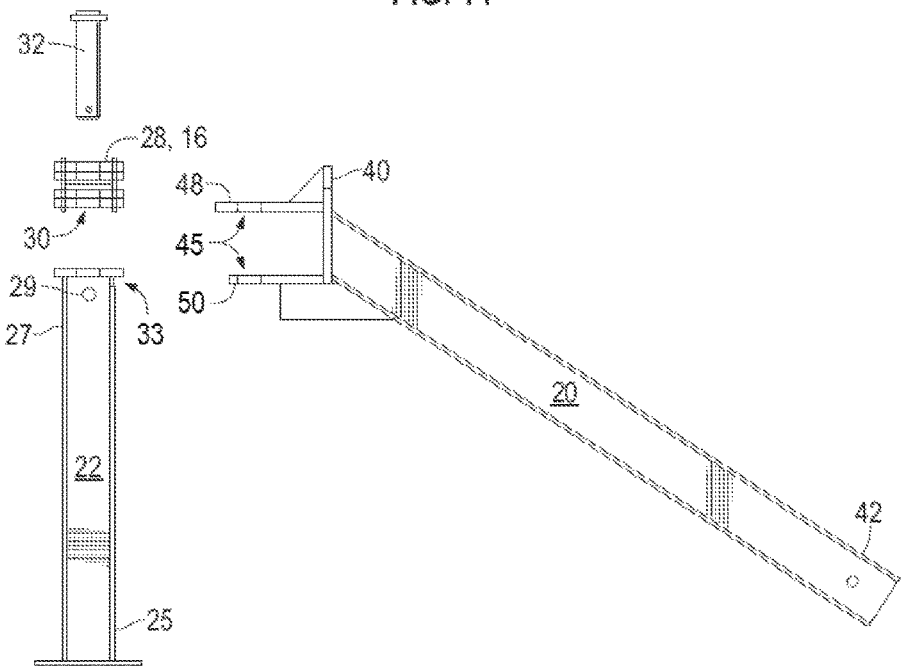
FIG. 11 is an exploded elevation view of the brace connection of FIG. 10.
Figure 12:
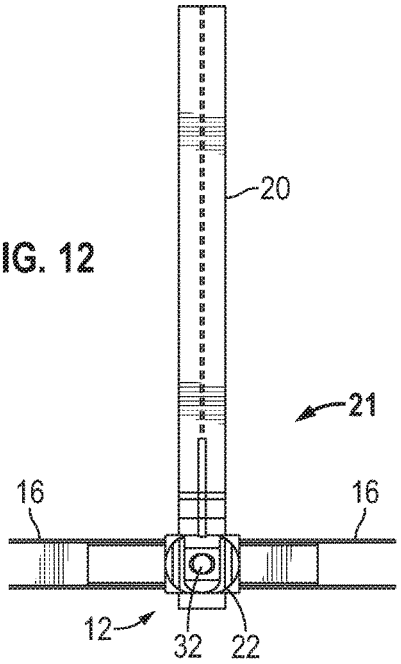
FIG. 12 is a plan view of the brace connection of FIG. 10.
Figure 13:
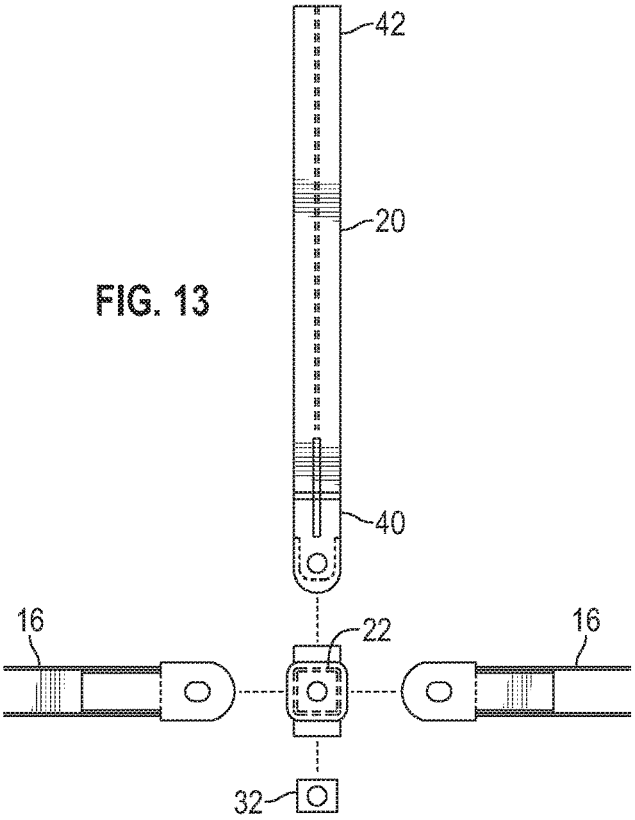
FIG. 13 is an exploded plan view of the brace connection of FIG. 10.

FIGS. 10-12 illustrates another example of a brace 20 connected with the beam at a joint interconnecting two adjacent beam sections. Brace 20 is for example a metal member extending from a first end 40 to a bottom end 42 to be disposed in the foundation. The brace 20 may take various forms including being an I-beam, such as a W-beam. In this example, the first end 40 includes top shelf or plate 48 and bottom spaced apart plate 50, which have coaxial holes 45 for disposing the pivot pin 32. In use, the beam plates 28 of the adjacent beam sections 16 are interleaved and disposed between the plates 48, 50 and the pivot pin 32 is disposed into the coaxial holes 45 in the plates 48, 50, and the holes 30 in the beam plates 28 thereby connecting the brace to the beam.

In accordance to some embodiments the brace 20 illustrated in FIGS. 10 to 13 may be connected to a vertical post 22 in a line post configuration 21. In the configuration of FIGS. 10-13, the beam and the vertical posts are aligned substantially in the same vertical plane, as illustrated for example in FIGS. 3 and 4. The post 22 has a bottom end 25 for example to be disposed in the foundation and an upper end 27 (e.g., FIG. 11). The post 22 may take various shapes and is described in this example, as a rectangular metal member. The beam plates 28 of the beam sections 16 may be connected to or proximate to the top end 27. For example, in the illustrated example, the bottom plate 50 of the pair of plates forming the first end of the brace may be positioned on top of the top end of the post or disposed through a slot 33 just below a top end of the post. The pivot pin 32 may be positioned through the beam plates, the first end of the brace and connected to the post 22. A locking mechanism 56 (FIG. 10) may be disposed through a cross-hole 29 (FIG. 11) to secure the pivot pin relative to the post 22.

Figure 14:
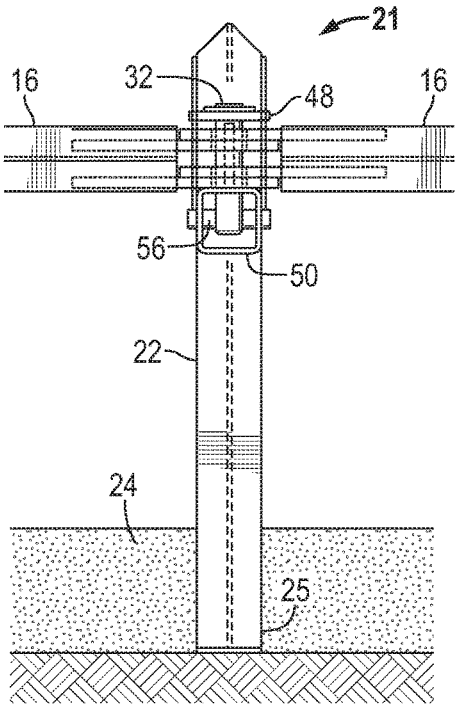
FIG. 14 is an elevation view from the attack side of another example of a brace connected to a beam at a joint between beam sections according to aspects of the disclosure.
Figure 15:
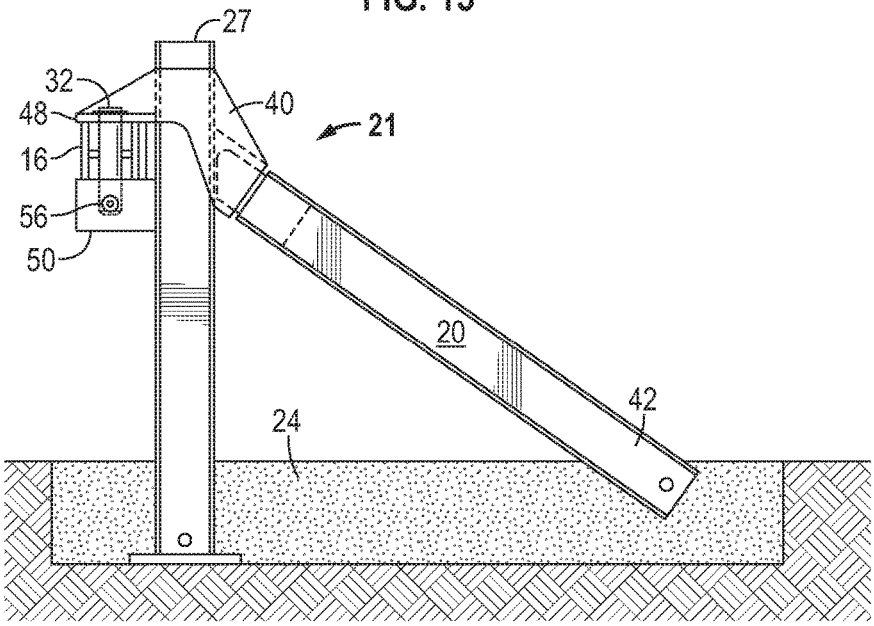
FIG. 15 is a side elevation view of the brace connection of FIG. 14.

FIGS. 14 and 15 illustrate another non-limiting example of a brace 20 connected to the beam at a joint 18 and at a vertical post 22 in a line post configuration 21. Vertical post 22 extends from a bottom end 25 disposed in a foundation 24 to a top end 27. The brace 20 has a first end 40 configured to be disposed over top end 27 of the post 22 and to connect to beam 12 such that the posts 22 are located on the protected side relative to the beam. A bottom shelf 50 is positioned on the attack side of the post 22. The beam plates 28 of the adjacent beam sections 16 are interleaved and positioned atop the bottom shelf 50 and between a top shelf 48 of the first end 40 of the brace 20 and the bottom shelf 50. The pivot pin 32 is disposed through the top and bottom shelves and the interleaved beam plates and a locking member 56 is disposed through the cross-hole 38 (FIG. 6) in the pivot pin 32. Similar to FIG. 7, the bottom shelf 50 may form a pocket in which the tail end of the pivot pin is located to provide resistance to tampering with the connection.

Figure 16:
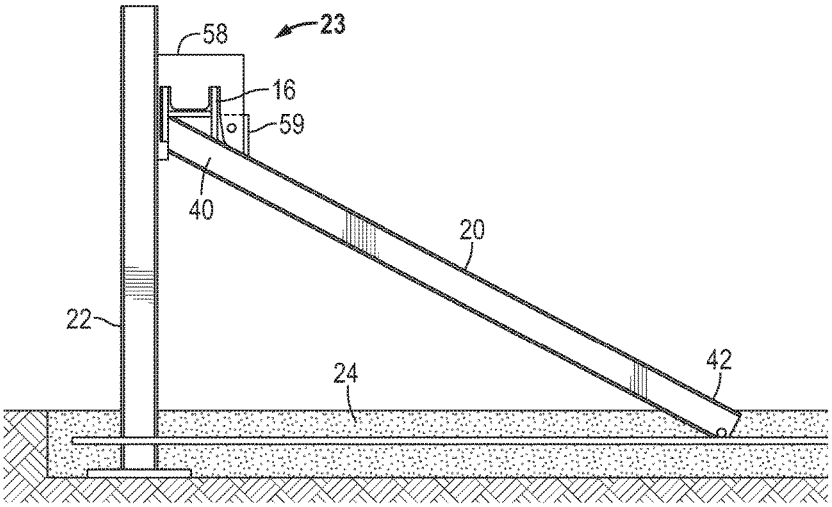
FIG. 16 is an elevation view of a brace connected to a beam at an intermediate position according to aspects of the disclosure.
Figure 17:
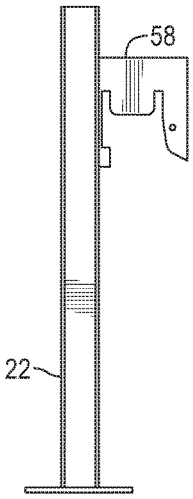
FIG. 17 illustrates an example of an intermediate post that may be connected to the beam and/or the beam and a brace according to aspects of the disclosure.
Figure 18:
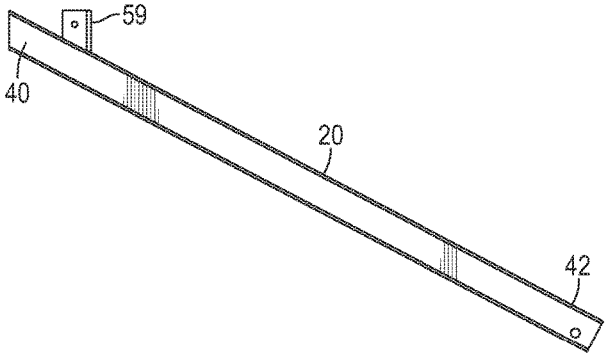
FIG. 18 illustrates the brace of FIG. 16 according to aspects of the disclosure.

FIG. 16 illustrates an example of a brace 20 connected to the beam at an intermediate position in accordance to one or more aspects of the disclosure. The brace 20 may also be connected to a post 22 in an intermediate configuration 23 as illustrated. With additional reference to FIGS. 17 and 18, the vertical post includes a bracket 58 located for example on the protected side to connect to a beam section 16. For example, in FIG. 17 the bracket 58 includes a W-pattern to be positioned atop a W-shaped (e.g., wide flange beam) I-beam section 16 as illustrated in FIG. 16. The brace 20, see FIG. 18, has a bracket 59 to connect to the post bracket 58 and that is positioned a distance back from the first end 40 such that the first end 40 of the brace can be positioned under the beam section 16 as illustrated in FIG. 16.

Figure 19:
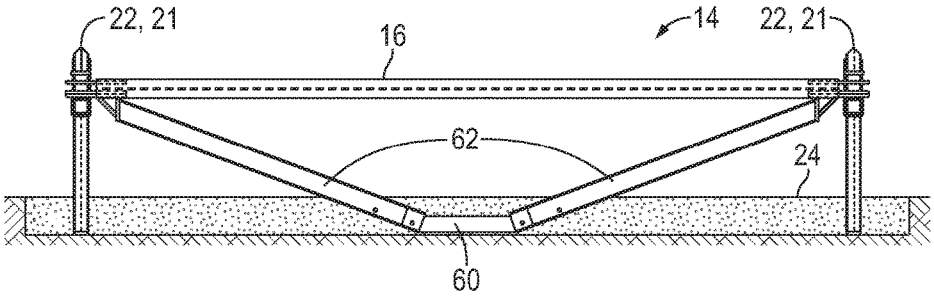
FIGS. 19 and 20 illustrate examples of truss sections according to aspects of the disclosure.
Figure 20:
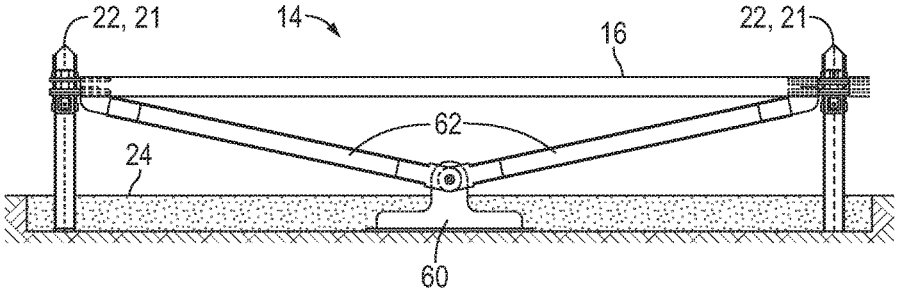

FIGS. 19 and 20 illustrate examples of truss sections 14 having a push-pull design in accordance to aspects of the disclosure, which are described with reference also to FIGS. 1-4. The truss sections 14 include spaced apart posts 22, which may be in a line post configuration 21. In accordance to a non-limiting example, the truss section of FIG. 19 includes braces 20 at each of the posts 22, which are arranged in a line post configuration such as illustrated in FIG. 7. In accordance to a non-limiting example, the truss section of FIG. 20 includes braces 20, such as illustrated in FIGS. 3 and 4, connected to the posts 22 that are arranged in a line post configuration such as illustrated in FIG. 10. A beam section 16 is connected between the posts 22 of the truss section 14. A truss anchor 60 is secured in the foundation proximate the center point between the posts 22 of the end section and one truss beam is connected to one post 22 and the truss anchor and another truss beam is connected to the other post and the truss anchor.

Figure 21:
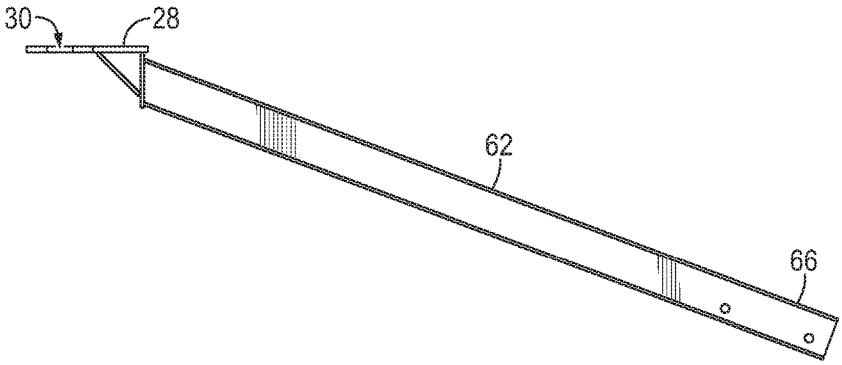
FIG. 21 illustrates an example of a truss beam according to aspects of the disclosure.

FIG. 21 illustrates an example of a truss beam 62 in accordance to an embodiment. The truss beam has a first end 64 having a beam plate 28 with a hole 30 and a second end 66 configured to connect with a truss anchor 60. In the example illustrated in FIG. 19, the second ends of the truss beam are disposed in the foundation 24.

A brace and beam vehicle barrier in accordance to at least one embodiment includes a plurality of interconnected beam sections, forming a beam positioned above ground level and secured to the ground via a plurality of spaced apart braces connected to the beam on a protected side of the beam, the brace and the ground forming two sides of a triangle to provide a stopping force to a motor vehicle impacting the beam from an attack side. In accordance to some embodiments, the anti-ram barrier meets ASTM F2656 standards. A plurality of spaced apart vertical ground posts may be connected to the beam, the vertical posts providing tension to the beam when it is impacted by the motor vehicle. One or more of the braces may be connected with a vertical post that forms a third side of the triangle.

In some embodiments the brace and beam is a shallow foundation vehicle barrier, for example set in about 5 inches to 20 inches of concrete. For example, the brace secured in a concrete foundation of about 5 inches to 20 inches in depth and the anti-ram vehicle barrier meeting desired certification standards for stopping a vehicle of a particular weight from penetrating beyond a defined distance when travelling at a prescribed fee impacting the anti-ram vehicle barrier. In accordance to some embodiments, the anti-ram barrier meets ASTM F2656 standards. In some embodiments, a continuous concrete foundation may extend below the continuous beam.

In accordance, to some embodiments, the brace is secured in concrete of less than about 18 inches in depth and the anti-ram vehicle barrier meets and/or is anticipated to meet certification standards for stopping a vehicle of a particular weight and travelling at a prescribed speed from penetrating the barrier beyond a defined distance after impacting the anti-ram vehicle barrier. In accordance, to some embodiments, the brace is secured in concrete of less than about 12 inches in depth and the anti-ram vehicle barrier meets and/or is anticipated to meet certification standards for stopping a vehicle of a particular weight from penetrating beyond a defined distance when travelling at a prescribed fee impacting the anti-ram vehicle barrier. In accordance, to some embodiments, the brace is secured in concrete of about 6 inches in depth and the anti-ram vehicle barrier meets and/or is anticipated to meet certification standards for stopping a vehicle of a particular weight from penetrating beyond a defined distance when travelling at a prescribed fee impacting the anti-ram vehicle barrier. In accordance to some embodiments, the brace is set in a deep foundation, for example about 18 inches or greater in depth. In accordance to some embodiments, the anti-ram barrier meets ASTM F2656 standards. In some embodiments, the braces may be set in concrete foundations having different dimensions and characteristics from other brace foundations. For example, the foundations of braces positioned at the joints may have a different depth from ground level and/or width and length from a foundations of a brace positioned at an intermediate position.

In accordance to some embodiments, a continuous beam extends a longitudinal distance between truss sections. The continuous beam is constructed of beam sections interconnected at joints. In accordance to some embodiments, the joints include a pivot connection permitting pivoting of the beam sections relative to one another. Spaced apart braces are located on a protected side of the beam and connected to the beam at a first end and secured in the foundation (e.g., ground or concrete) at the second end whereby the foundation and the brace form two adjacent sides of a vertex having an acute angle. The brace may be positioned and/or connected at a vertical post that forms the third side of the triangle. The vertical posts are secured in the foundation and connected to the beam to provide tension and mitigate lift of the beam in response to impact of a motor vehicle. The adjacent triangle sides of the foundation and the brace serve as a sled to absorb the force of a motor vehicle impacting the beam. The foundation may be a deep or a shallow foundation. For example, the braces may be set in a shallow foundation of less than about eighteen inches. In some embodiments, the braces are set in a foundation of less than about fourteen inches. In some embodiments, the braces are set in a foundation of about twelve inches or less. The foundations may extend under the length of the continuous beam or foundation sections may be set in selective locations for example at each of the braces.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An anti-ram vehicle barrier, comprising:

a longitudinally extending beam positioned vertically above a ground level and separating a protected side from an attack side, the beam comprising beam sections pivotally interconnected at joints; and a brace positioned on the protected side of the beam and having a first end pivotally connected to the beam at one of the joints and a second end positioned in a concrete foundation such that the brace and the concrete foundation form two adjacent sides of a vertex having an acute angle, wherein the anti-ram vehicle barrier is configured to achieve an ASTM F2656 designation capable of stopping a 15,000 pound vehicle impacting the beam when traveling in a direction from the attack side toward the protected side within a determined distance.

2. The barrier of claim 1, further comprising a second brace having a first end connected to the beam at an intermediate position between the joints and a second end positioned in a concrete foundation such that the second brace and the concrete foundation form two adjacent sides of a vertex having an acute angle.

3. The barrier of claim 1, further comprising a vertical line post having a bottom end positioned in the concrete foundation and the line post connected to the beam and the brace, such that the brace, the concrete foundation and the vertical line post form a triangle.

4. The barrier of claim 1, wherein the concrete foundation is a shallow concrete foundation formed at ground level and extending a depth of about 18 inches or less below ground level.

5. The barrier of claim 1, wherein the beam extends between opposing truss sections.

6. The barrier of claim 3, wherein the concrete foundation is formed at ground level and extending a depth of about 12 inches or less below ground level.

7. The barrier of claim 3, wherein the vehicle barrier is configured to achieve an ASTM F2656 M50-P1 designation.

8. The barrier of claim 3, wherein the line post is connected to the beam and the brace at the pivotal connection by a single vertical pivot pin.

9. The barrier of claim 8, wherein line post is located on the protected side of the beam.

10. The barrier of claim 8, wherein line post and the beam are aligned in a same vertical plane.

11. The barrier of claim 8, wherein line post is located on the attack side of the beam.

12. The barrier of claim 11, wherein the concrete foundation is formed at ground level and extending a depth of about 12 inches or less below ground level.

13. The barrier of claim 12, wherein the vehicle barrier is configured to achieve an ASTM F2656 M50-P1 designation.

14. A method comprising:

installing a vehicle barrier comprising a longitudinally extending beam positioned above a ground level and separating a protected side from an attack side, the beam comprising beam sections pivotally interconnected at joints, and a line brace positioned on the protected side of the beam and having a first end pivotally connected to the beam at one of the joints and a second end secured in a concrete foundation such that the line brace and the concrete foundation form two adjacent sides of a vertex having an acute angle, wherein the vehicle barrier is configured to achieve an ASTM F2656 designation capable of stopping a 15,000 pound vehicle impacting the beam when traveling in a direction from the attack side toward the protected side within a determined distance.

15. The method of claim 14, further comprising crash testing the installed vehicle barrier by ramming a vehicle traveling in a direction from the attack side toward the protected side into the beam.

16. The method of claim 14, wherein the beam sections and the line brace are pivotally connected together by a single vertical pivot pin at the one of the joints.

17. The method of claim 14, further comprising a line post having a bottom end positioned in the concrete foundation and the line post connected to the beam and the line brace at the pivotal connection of the line brace to the beam.

18. The method of claim 14, further comprising a line post having a bottom end positioned in the concrete foundation and the line post connected to the beam and the line brace at the pivotal connection of the line brace to the beam, wherein the line post is located on the attack side of the beam.

19. The method of claim 14, further comprising a line post having a bottom end positioned in the concrete foundation and the line post connected to the beam and the line brace at the pivotal connection of the line brace to the beam;

an intermediate brace having a first end non-pivotally connected to the beam at an intermediate location between joints and a second end secured in a concrete foundation such that the intermediate brace and the concrete foundation form two adjacent sides of a vertex having an acute angle; and an intermediate post connected to the beam and the intermediate brace.

20. The method of claim 19, wherein the concrete foundation is a shallow concrete foundation extending at a depth of 18 inches or less below the ground level.

21. The method of claim 14, further comprising a line post having a bottom end positioned in the concrete foundation and the line post connected to the beam and the line brace at the pivotal connection of the line brace to the beam, wherein the beam sections and the line brace are pivotally connected together by a single vertical pivot pin at the one of the joints;

an intermediate brace having a first end non-pivotally connected to the beam at an intermediate location between joints and a second end secured in a concrete foundation such that the intermediate brace and the concrete foundation form two adjacent sides of a vertex having an acute angle; and an intermediate post connected to the beam and the intermediate brace.

22. The method of claim 21, wherein the line post and the intermediate post are located on the attack side.

23. The method of claim 14, further comprising installing a line post having a bottom end positioned in the concrete foundation and the line post connected to the beam and the line brace at the pivotal connection of the line brace to the beam, wherein the beam sections and the line brace are pivotally connected together by a single vertical pivot pin at the one of the joints, wherein the concrete foundation is a shallow concrete foundation extending at a depth of 18 inches or less below the ground level.

24. The method of claim 23, wherein the line post and the beam are aligned in a same vertical plane.

25. A vehicle barrier, comprising:

a longitudinally extending beam positioned vertically above a ground level and separating a protected side from an attack side, the beam comprising beam sections pivotally interconnected at joints;

a line brace positioned on the protected side, the line brace having a first end pivotally connected to the beam at one of the joints and a second end secured in a concrete foundation;

a line post having a bottom end positioned in the concrete foundation and the line post connected to the beam and the line brace at the pivotal connection of the line brace to the beam;

an intermediate brace positioned on the protected side, the intermediate brace having a first end connected to the beam at an intermediate location between the joints and a second end secured in a concrete foundation such that the intermediate brace and the concrete foundation form two adjacent sides of a vertex having an acute angle; and an intermediate post having a bottom end connected to the beam and the intermediate brace:

wherein the vehicle barrier is configured to achieve an ASTM F2656 designation capable of stopping a 15,000 pound vehicle impacting the beam when traveling in a direction from the attack side toward the protected side within a determined distance.

26. The vehicle barrier of claim 25, wherein the line post and the intermediate post are located on the attack side.

27. The vehicle barrier of claim 25, wherein the beam sections and the line brace are pivotally connected together by a single vertical pivot pin at the one of the joints.

28. The vehicle barrier of claim 25, wherein the line post and the intermediate post are located on the attack side; and the beam sections and the line brace are pivotally connected together by a single vertical pivot pin at the one of the joints.

29. The vehicle barrier of claim 25, wherein the vehicle barrier is configured to achieve an ASTM F2656 M50-P1 designation.

30. The vehicle barrier of claim 25, wherein the vehicle barrier is configured to achieve an ASTM F2656 M40-P2 designation.

* * * * *